US010280803B2

(12) United States Patent
Ortmann et al.

(10) Patent No.: US 10,280,803 B2
(45) Date of Patent: May 7, 2019

(54) ENERGY STORAGE DEVICE AND METHOD FOR STORING ENERGY

(71) Applicants: Peter Ortmann, Schaffhausen (CH); Werner Graf, Schaffhausen (CH)

(72) Inventors: Peter Ortmann, Schaffhausen (CH); Werner Graf, Schaffhausen (CH)

( * ) Notice: Subject to any disclaimer, the term of this patent is extended or adjusted under 35 U.S.C. 154(b) by 3 days.

(21) Appl. No.: 15/568,685

(22) PCT Filed: Apr. 19, 2016

(86) PCT No.: PCT/EP2016/058654
§ 371 (c)(1),
(2) Date: Oct. 23, 2017

(87) PCT Pub. No.: WO2016/169928
PCT Pub. Date: Oct. 27, 2016

(65) Prior Publication Data

US 2018/0142577 A1 May 24, 2018

(30) Foreign Application Priority Data

Apr. 24, 2015 (EP) ..... 15165025

(51) Int. Cl.
*F01K 3/00* (2006.01)
*F01K 25/00* (2006.01)
(Continued)

(52) U.S. Cl.
CPC ..... *F01K 3/006* (2013.01); *F01K 3/06* (2013.01); *F01K 3/12* (2013.01); *F01K 25/00* (2013.01); *F01K 25/005* (2013.01)

(58) Field of Classification Search
CPC ..... F01K 3/006; F01K 25/005; F01K 3/12; F01K 3/06; F01K 25/00
(Continued)

(56) References Cited

U.S. PATENT DOCUMENTS 5,269,145 A * 12/1993 Krause ..... C09K 5/063 60/659
8,261,552 B2 9/2012 Nakhamkin
(Continued)

FOREIGN PATENT DOCUMENTS

DE 102011088380 6/2013
DE 102013217607 3/2015
(Continued)

OTHER PUBLICATIONS

International Search Report for PCT/EP2016/058654, English Translation attached to original, Both completed by the European Patent Office on Jun. 10, 2016, All together 5 Pages.

*Primary Examiner* — Hoang Nguyen
(74) *Attorney, Agent, or Firm* — Brooks Kushman P.C.

(57) ABSTRACT

An energy storage device for storing energy including: a high-temperature regenerator containing a storage material and a working gas as heat transfer medium for the purpose of exchanging heat between the storage material and the traversing working gas, a closed charging circuit for the working gas, including a first compressor, a first expander, a first recuperator having a first and a second heat exchange duct, the high-temperature regenerator and a pre-heater, wherein the first compressor is coupled to the first expander by a shaft, a discharging circuit for the working gas, and including a switch that selectively connects the high-temperature regenerator to either the charging circuit or the discharging circuit, such that the circuit containing the high-temperature regenerator forms a closed circuit.

15 Claims, 7 Drawing Sheets

(51) Int. Cl.
*F01K 3/06* (2006.01)
*F01K 3/12* (2006.01)

(58) Field of Classification Search
USPC ..... 60/650, 659, 682–684
See application file for complete search history.

(56) References Cited

U.S. PATENT DOCUMENTS

| | | | | |
|---|---|---|---|---|
| 8,627,665 | B2 | 1/2014 | Ruer | |
| 9,322,297 | B2 | 4/2016 | Brunhuber et al. | |
| 9,518,786 | B2 * | 12/2016 | Howes | F01K 3/12 |
| 2014/0008033 | A1 * | 1/2014 | Howes | F28D 20/0056 165/10 |
| 2016/0248299 | A1 * | 8/2016 | Ouvry | F01K 3/12 |

FOREIGN PATENT DOCUMENTS

| | | |
|---|---|---|
| EP | 2220343 | 6/2013 |
| EP | 2147193 | 10/2013 |
| WO | 2013164562 | 11/2013 |

* cited by examiner

ENERGY STORAGE DEVICE AND METHOD FOR STORING ENERGY

CROSS-REFERENCE TO RELATED APPLICATION

This application is the U.S. national phase of PCT Application No. PCT/EP2016/058654 filed on Apr. 19, 2016, which claims priority to EP Patent Application No. 15165025.6 filed on Apr. 24, 2015, the disclosures of which are incorporated in their entirety by reference herein.

DESCRIPTION

The invention relates to an energy storage device for storing energy. The invention additionally relates to a method for storing energy.

PRIOR ART

Renewable energy sources such as wind energy or solar energy are increasingly used for energy production. In order to ensure a sustainable and stable energy supply based on renewable energy sources, it is necessary for produced energy to be stored and delivered back in a deferred manner. For this purpose, there is a need for inexpensive energy storage devices that can temporarily store excess energy and deliver it back in a deferred manner.

The document EP2147193B1 discloses, on the one hand, a device and a method for storing thermal energy. The document additionally discloses a device for storing electrical energy and delivering it in a deferred manner. In this case, for the purpose of charging the energy store, electrical energy is converted into heat, and stored as thermal energy. Upon discharging, the thermal energy is converted back into electrical energy, and is then delivered. This device and this method have the disadvantages that their operation requires two separate energy storages, a heat storage and a cold storage, which, moreover, also have to be operated at very high temperature, of up to 2000° C., and very low temperature, of down to −80° C., with the result that the construction, the operation and the maintenance of the device, which also comprises, besides the heat storage and the cold storage, compressors, heat exchangers, etc., are very elaborate and expensive. Moreover, the necessary compressors are relative large, and their power density is low.

The document DE 10 2011 088380 A1 discloses an energy storage device for storing excess electrical energy that occurs seasonally. The energy storage is effected in a very long-term manner. The discharging of the stored energy is effected by means of a steam circuit. This device is disadvantageous in respect of efficiency and in respect of costs.

PRESENTATION OF THE INVENTION

It is therefore an object of the present invention to create an economically more advantageous energy storage device and an economically more advantageous method for storing energy.

It is additionally an object of the present invention to create, in particular, an economically more advantageous device and an economically more advantageous method for storing and recovering electrical energy.

This object is achieved by a device having the features of claim 1. The dependent claims 2 to 10 relate to further, advantageous embodiments. The object is further achieved by a method having the features of claim 11. The dependent claims 12 to 14 relate to further, advantageous method steps.

The object is achieved, in particular, by an energy storage device for storing energy, comprising:

- a high-temperature regenerator containing a solid, in particular porous, storage material, and a working gas as a heat transfer medium, for the purpose of exchanging heat between the storage material and the working gas flowing through, —a closed charging circuit for the working gas, comprising a first compressor, a first expander, a first recuperator that has a first and a second heat exchange duct, the high-temperature regenerator and a preheater, wherein the first compressor is coupled to the first expander by means of a shaft, and wherein the charging circuit is realized in such a manner that, starting from the high-temperature regenerator, at least the first heat exchange duct of the recuperator, the first expander, the preheater, the second heat exchange duct of the recuperator, the first compressor, and then the high-temperature generator, are connected to each other in a fluid-conducting manner, forming a closed circuit,
- a closed discharging circuit for the working gas, and comprising—a switching means that in a fluid-conducting manner connects the high-temperature regenerator either to the charging circuit or to the discharging circuit in a controllable manner, such that the high-temperature regenerator forms either a part of the charging circuit or a part of the discharging circuit, and the charging circuit, the discharging circuit and the high-temperature regenerator have the same working gas, such that the working gas preferably comes into direct contact with the storage material, both in the charging circuit and in the discharging circuit.

The object is further achieved, in particular, by a method for storing thermal energy in an energy storage device comprising a high-temperature regenerator that contains a solid storage material, in that a working gas is circulated, as a heat transfer medium, in a closed charging circuit, wherein the working gas exchanges heat with the storage material, and wherein the working gas after the high-temperature regenerator is cooled in a first recuperator, then expanded in a first expander, then preheated in a first preheater, then heated in the first recuperator, then compressed in a compressor and heated, and the thus heated working gas is supplied to the high-temperature regenerator, and wherein thermal energy is removed from the high-temperature regenerator via a closed discharging circuit, wherein the high-temperature regenerator forms either a part of the charging circuit or a part of the discharging circuit, in that the high-temperature regenerator is switched in a fluid-conducting manner either into the charging circuit or into the discharging circuit, such that a closed circuit is realized, in which the working gas circulates. The same working gas is present in the charging circuit, in the discharging circuit and in the high-temperature regenerator. Both in the charging circuit and in the discharging circuit, the working gas flows directly around the storage material, and consequently the latter comes into direct contact with the working gas.

The energy storage device according to the invention comprises a high-temperature regenerator that contains a solid storage material, and a working gas as a heat transfer medium, in order to exchange heat between the working gas and the storage material, by means of the working gas flowing through, along the storage material.

In the case of heat exchangers, a distinction is made, inter alia, between a recuperator and a regenerator. In the case of a recuperator, two fluids are conducted in mutually separate spaces, wherein a transfer of heat occurs between the spaces. Thus, in a recuperator, two fluids are separated completely, for example by means of a dividing wall, wherein thermal energy is transferred between the two fluids via the common dividing wall. A regenerator is a heat exchanger in which the heat is stored temporarily in a medium during the exchange operation. In the case of a regenerator, in a possible embodiment the working gas flows directly around the storage material. During charging of the regenerator, the thermal energy supplied by the working gas is delivered to the storage material, and stored in the storage material. During discharging of the regenerator, thermal energy is removed from the storage material by the working gas, the storage material is cooled, and the thermal energy removed by the working gas is supplied to a subsequent process. In the case of the regenerator, the working gas advantageously comes into direct contact with the storage material, both during charging and during discharging.

The energy storage device according to the invention has the advantage that only one energy storage, and possibly also a hot-water storage, is required. The energy storage device according to the invention also comprises, besides the high-temperature regenerator, a charging circuit, a discharging circuit, and switching means in order to connect to the high-temperature regenerator for the purpose of charging the charging circuit or for the purpose of discharging the discharging circuit. A solid material such as, for example, porous, fire-resistant stones, sand, gravel, concrete, graphite or a ceramic is suitable as a storage material in the high-temperature regenerator. The storage material may be heated to a temperature in the range of, preferably, between 600 and 1000° C., and if necessary even up to 1500° C. The charging circuit and the discharging circuit are designed as a closed circuit. The embodiment has the advantage that the working gas may also have a pressure above atmospheric, which correspondingly increases the power density of the compressors and turbines. In an advantageous embodiment, argon or nitrogen is used as a working gas. Other gases, however, are also suitable as working gases. The energy storage device according to the invention has the advantage that it has a high energy density, such that the high-temperature generator can be of a relatively compact design. Moreover, the high-temperature regenerator can be produced inexpensively, since the storage material is very convenient and environmentally compatible. The energy storage device according to the invention additionally has the advantage that the discharging circuit can differ in its design, according to the requirement, for example in order to generate electrical energy.

In a particularly advantageous design, the energy storage device comprises an electric generator and, in a preferred design, additionally an electric motor, such that the energy storage device according to the invention can be charged with electrical energy, and also delivers back electrical energy upon discharging. Such an energy storage device is also referred to as an "electricity energy storage system by means of pumped heat (ESSPH)". The energy storage device according to the invention, comprising an electric generator and an electric motor, is thus able to convert electrical energy into thermal energy, store the thermal energy, and convert the stored thermal energy back into electrical energy. The energy storage device according to the invention can thus also be referred to as a "thermal battery" that can be charged by means of a charging operation and discharged by means of a discharging operation, the charging operation being effected by use of a hot-gas thermal pump and the discharging operation preferably being effected by use of a gas turbine process. Rotating turbo machines or linear piston machines, in particular, are suitable for the purpose of compression and expansion.

Insofar as partial charging or partial discharging is also possible at any time, the energy storage device according to the invention, or the thermal battery, can be charged and discharged in a manner similar to that of an electric battery. The storage concept on which the energy storage device according to the invention is based makes it possible, by appropriate design of the sub-components, to store power outputs in the range of between 1 and 50 MW and energy quantities in the range of between 1 and 250 MWh, and to deliver these back in a deferred manner. In a particularly advantageous design, the electric generator and the electric motor are designed as a single machine, in the form of a motor generator. The energy storage device according to the invention is eminently suitable for time-shifting electrical energy, for example in order to store solar energy, occurring in the daytime, in an electrical grid, and to deliver it back again at night. Moreover, the energy storage device is eminently suitable for stabilizing the electrical grid, in particular for frequency stabilization, insofar as the compressors and expanders of the energy storage device are designed as rotating machines. In an advantageous operating mode, the energy storage device is operated at a constant rotational speed, and is connected to the electrical grid.

The invention is described in detail in the following on the basis of exemplary embodiments.

BRIEF DESCRIPTION OF THE DRAWINGS

The drawings used to explain the exemplary embodiments show.

Figure 1:
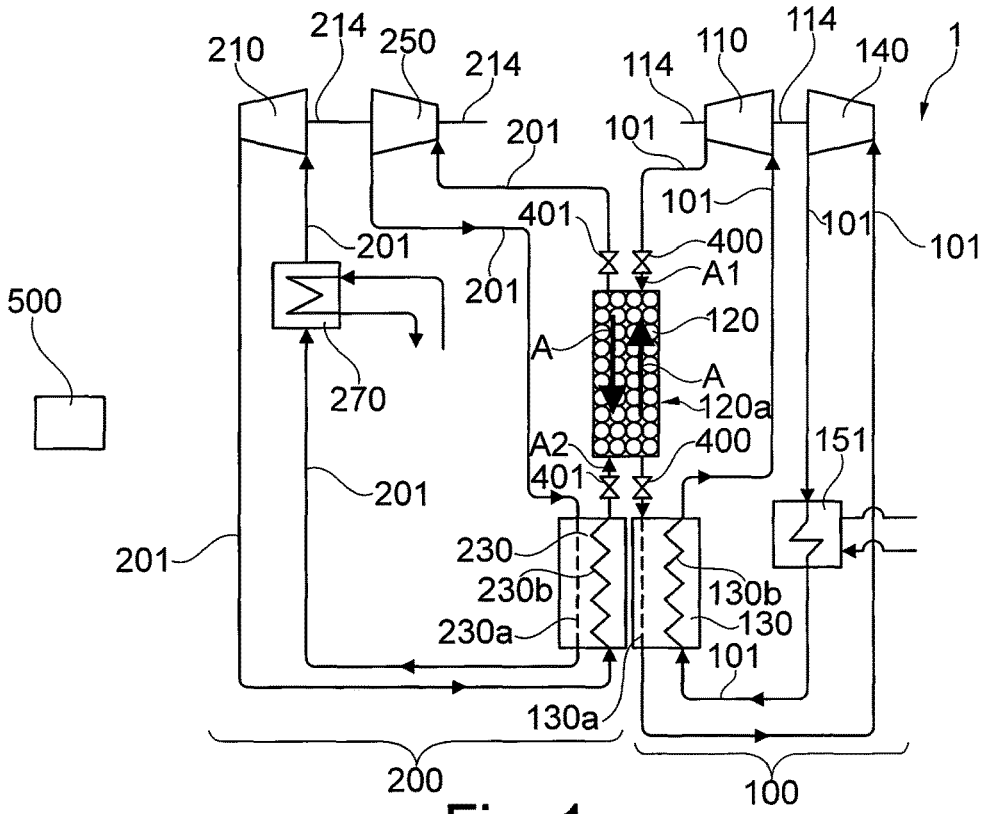
FIG. 1 a first exemplary embodiment of an energy storage device comprising a charging circuit and a discharging circuit.

In principle, in the drawings, parts that are the same are denoted by the same references.

WAYS OF EMBODYING THE INVENTION

Figure 2:
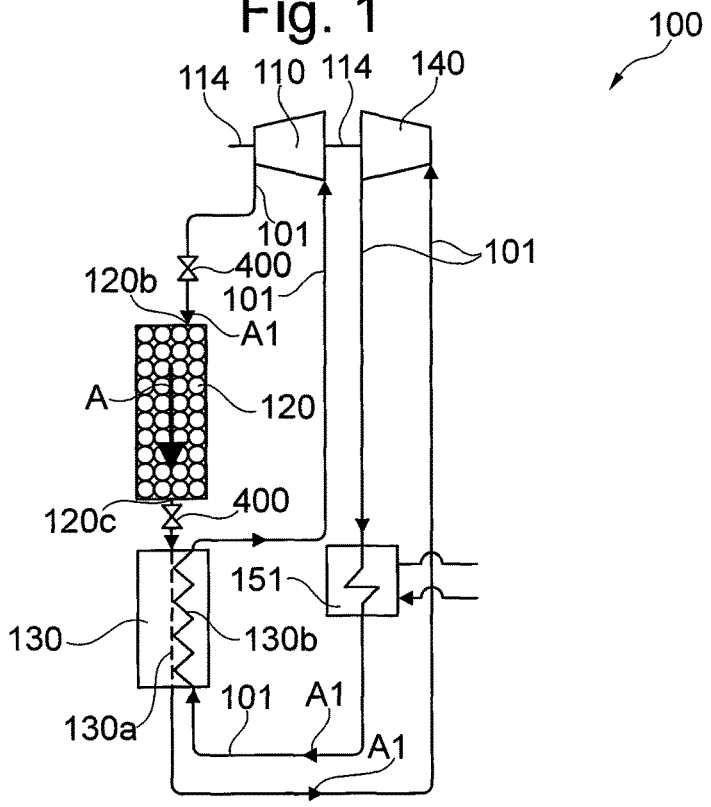
FIG. 2 the charging circuit according to FIG. 1, in detail.
Figure 3:
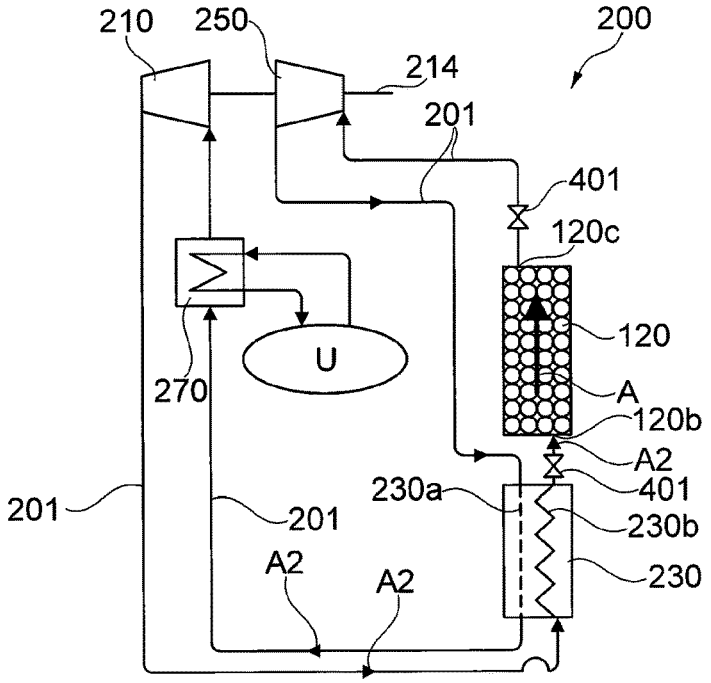
FIG. 3 the discharging circuit according to FIG. 1, in detail.

FIG. 1 shows an energy storage device 1 for storing thermal energy, comprising a charging circuit 100 having lines 101, a discharging circuit 200 having lines 201, a high-temperature regenerator 120 and switching means 400, 401, the switching means 400, 401 being connected to the lines 101, 201 in such a manner that the high-temperature regenerator 120 can be connected in a fluid-conducting manner either to the charging circuit 100 or to the discharging circuit 200, such that the high-temperature regenerator 120 forms a part of the charging circuit 100 or a part of the discharging circuit 200, respectively. A closed-loop control device 500 is connected in a signal-conducting manner to the switching means 400, 401, and to other sensors and actuators, not represented in detail, for the purpose of controlling the energy storage device 1. FIGS. 2 and 3 show in detail, respectively, the charging circuit 100 and discharging circuit 200 represented in FIG. 1. The high-temperature regenerator 120 contains a solid storage material and a working gas A as a heat transfer medium, in order to exchange heat between the storage material and the working gas A flowing through. Suitable as a solid storage material for the high-temperature regenerator, for example, are porous, fire-resistant materials, stones, sand, gravel, concrete, graphite, or also a ceramic such as silicon carbide. The high-temperature regenerator 120 comprises an outer cover 120*a* and an inner space, the solid storage material being disposed in the inner space and/or designed in such a manner that the working gas A flows through, or can flow around, the storage material for the purpose of heat exchange. As can be seen from FIG. 2, the high-temperature regenerator 120 additionally comprises at least one inlet opening 120*b* and at least one outlet opening 120*c*, in order for the working gas A flowing in the lines 101 and 201 to be, respectively, delivered to and removed from the inner space of the high-temperature regenerator, such that the working gas A circulating in the charging circuit 100 or in the discharging circuit 200 comes into direct contact with the solid storage material. FIG. 1 shows a high-temperature regenerator 120 extending or disposed in a vertical direction, the working gas A flowing from top to bottom during charging, and flowing from bottom to top during discharging.

The closed charging circuit 100 represented in FIG. 1 is shown in detail in FIG. 2. The closed charging circuit 100 for the working gas A comprises a first compressor 110, a first expander 140, a first recuperator 130 having a first and a second heat exchange duct 130*a*, 130*b*, the high-temperature regenerator 120 and a preheater 151, the first compressor 110 being coupled to the first expander 140 via a common shaft 114. The switching means 400, realized as valves, are switched to through-flow, and the switching means 401, not represented in FIG. 2, are blocked, such that a closed charging circuit 100 is realized, in which the working gas A flows in the direction of flow A1, or in the charging flow direction A1. Preferably, argon or nitrogen is used as a working gas A. The working gas A is advantageously kept at a pressure above atmospheric, in order to increase the power density of the compressor 110 and of the turbine 140, and to improve the heat transfer in the caloric devices. The pressure is preferably in a range of from 1 to 20 bar. Starting from the high-temperature regenerator 120, the working gas A is supplied in succession at least to the first heat exchange duct 130*a* of the recuperator 130, the first expander 140, the preheater 151, the second heat exchange duct 130*b* of the recuperator 130, the first compressor 110, and then again to the high-temperature regenerator 120, forming a closed, fluid-conducting circuit. The first compressor 110, the first expander 140, the first recuperator 130 and the preheater 151 for a heat pump. The working gas A preheated by the preheater 151 and the recuperator 130 is supplied as an inlet gas to the first compressor 110, compressed therein, and as a result undergoes an increase in temperature and pressure. The compressed working gas A is supplied to the high-temperature generator 120, cooled therein, then cooled further in the recuperator 130, and then expanded in the first expander 140, in order then to be preheated again in the preheater 151 and in the recuperator 130. The first expander 140 and the compressor 110 are disposed on the same shaft 114, such that the first expander 140 assists the driving of the first compressor 110. The shaft 114 is driven by a drive device, not represented, for example an electric motor, a turbine, or generally a power engine.

A discharging circuit 200 is required in order for the thermal energy stored in the high-temperature regenerator 120 to be discharged again. This discharging circuit 200 may be of differing designs, depending on the requirement for which the stored thermal energy is needed. FIG. 3 shows in detail the closed discharging circuit 200 represented in FIG. 1, which is designed as a gas turbine process. The working gas A used is the same as in the charging circuit 100, preferably argon or nitrogen. The closed discharging circuit 200 for the working gas A comprises a second compressor 210, a second expander 250, a second recuperator 230 having a first and a second heat exchange duct 230*a*, 230*b*, the high-temperature regenerator 120 and a first cooler 270, wherein the second compressor 210 is coupled to the second expander 250 via the shaft 214. The switching means 401, designed as valves, are switched to through-flow, and the switching means 400, not represented in FIG. 3, are blocked, such that a closed discharging circuit 200 is realized, in which the working gas A flows in the direction of flow A2, or in the discharging flow direction A2. The discharging circuit 200 is realized in such a manner that, starting from the high-temperature regenerator 120, at least the second expander 250, the first heat exchange duct 230*a* of the second recuperator 230, the first cooler 270, the second compressor 210, the second heat exchange duct 230*b* of the recuperator 230, and then the high-temperature regenerator 120, are connected to each other in succession in a fluid-conducting manner, forming the closed circuit, the working gas A flowing in the direction of flow A2, or in the discharging flow direction A2, in the discharging circuit 200. As represented in FIG. 3, in the first cooler 270 cooling is effected to ambient temperature U. As can be seen from FIGS. 2 and 3, in the high-temperature regenerator 120 the discharging flow direction A2 flows in a direction opposite to the charging flow direction A1. The working gas A flowing out of the high-temperature regenerator 120 is expanded via the second expander 250 and is thereby cooled, and is then cooled further in the second recuperator 230 and in the first cooler 270, before the working gas A is compressed in the second compressor 210 and then preheated in the second recuperator 230, in order then to flow back into the high-temperature regenerator 120. The second compressor 210 and the second expander 250 are disposed on the same shaft 214, such that the second expander 250 drives the second compressor 210. Energy is taken from the shaft 214 by an arrangement that is not represented, it being possible, for example, for a generator or a machine to be connected to the shaft 214.

Figure 4:
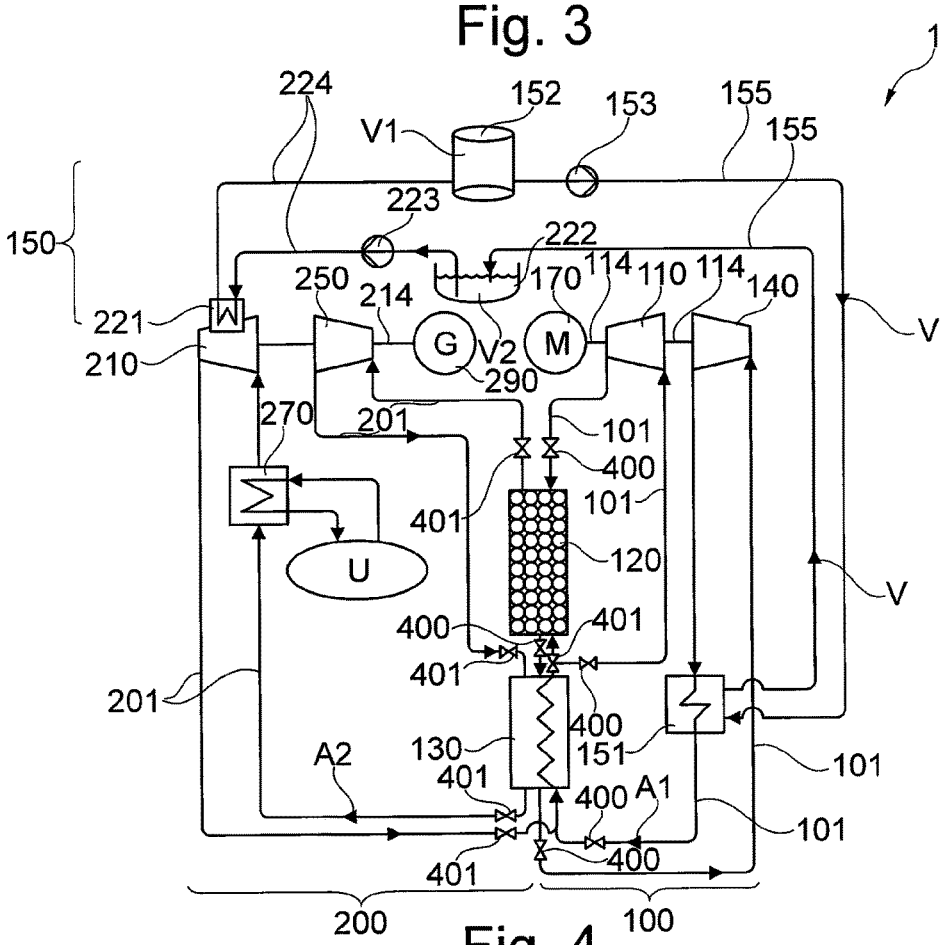
FIG. 4 a second exemplary embodiment of an energy storage device.

FIG. 4 shows a particularly advantageous of an energy storage device 1. Unlike the energy storage device 1 having two separate recuperators 130 that is represented in FIGS. 1 to 3, the energy storage device 1 represented in FIG. 4 has a single, common recuperator 130. The working gas A is conducted in a switchable manner by use of switching means 400, 401 such as valves, in such a manner that a charging circuit 100 or a discharging circuit 200 is produced, similar to the charging circuit 100 or discharging circuit 200 represented in FIGS. 2 and 3 respectively, with the exception that there is only a single, common recuperator 130.

In a further, particularly advantageous design, the energy storage device 1 also comprises, besides the charging circuit 100 and the discharging circuit 200, a preheating system 150 for a circulating preheating fluid V. The preheating system 150 comprises, in particular, a first fluid storage 152, in which a heated preheating fluid V1 is stored, a second fluid storage 222, in which a cooled preheating fluid V2 is stored, and fluid lines 155, 224, and possibly conveying means 153, 223, in order to circulate the preheating fluid V in the preheating system 150 and, in particular, to supply it to the preheater 151 and to the cooler 221. In the exemplary embodiment represented, the preheating fluid V, starting from the first fluid storage 152, the heated preheating fluid V is supplied to the preheater 151, and the subsequently cooled preheating fluid V is supplied to the second fluid storage 222. The cooled preheating fluid v of the second fluid storage 222 is supplied to a cooler 221, and the subsequently heated preheating fluid V is supplied to the first fluid storage 152. Water is preferably used as a preheating fluid V, since water has a high storage density in respect of heat. The second fluid storage 222 could be designed as a fluid vessel, such that the preheating system 150 realizes a closed circuit. The second fluid storage 222 could also be of an open design, in which case, in place of a vessel, a body of water, for example a lake, would also be suitable for receiving the cooled preheating fluid V or providing cooling fluid V.

In a particularly advantageous design, the energy storage device 1 is used for storing electrical energy and delivering electrical energy in a deferred manner. FIG. 4 shows such a storage device for electrical energy, comprising the energy storage device 1, and comprising an electric motor 170 and a generator 290. In a particularly advantageous design, the electric motor 170 and the generator 290 are combined for form a single machine, forming a so-called motor generator. The energy storage device 1 represented in FIG. 4 can therefore be produced in a particularly advantageous manner, since only a single motor generator 170/290, a single high-temperature regenerator 120 and a single recuperator 130 are required.

Some further details of the functioning of the particularly advantageous energy storage device 1 represented in FIG. 4 are explained in the following. In the charging circuit 100, the first compressor 110, the first expander 140, the first recuperator 130 and the preheater 151 form a heat pump. The preheated working gas A is supplied to the first compressor 110 and therein is brought to the maximum pressure, or to the maximum temperature in the charging circuit 100. The working gas A is then conducted through the high-temperature regenerator 120, being thereby cooled, and then cooled again in the recuperator 130. The working gas A is then expanded in the first expander 140, to the lowest pressure in the charging circuit 100, the energy that is thereby released in the first expander 140 being used for partially driving the first compressor 110. The working gas A then flows through the preheater 151, and is thereby preheated. The preheater 151 is connected to the preheating system 150, and procures the thermal energy from the first fluid storage 152 for the warm preheating fluid, as warm water in the embodiment represented.

The discharging circuit 200 comprises a second compressor 210, designed as an intermediately cooled gas-turbine compressor having a cooler 221, and comprises the recuperator 130, the high-temperature regenerator 120, the second expander 250 and the first cooler 270, which cools to ambient temperature U. The cooler 221 is connected to the preheating system 150 via lines 224, cool fluid being taken from the storage 222, supplied to the cooler 221 via the conveying means 223, and the heated fluid being supplied to the storage 152.

Figure 5:
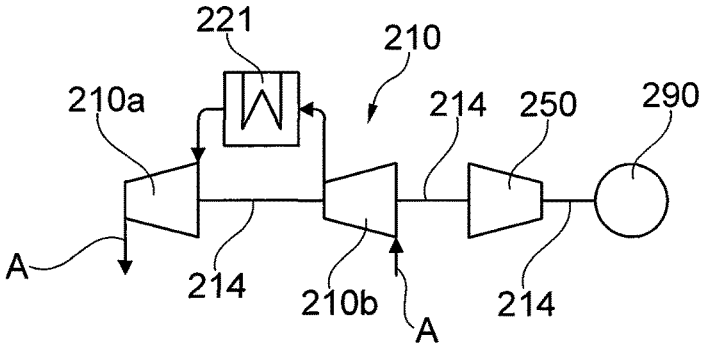
FIG. 5 a detail view of a compressor in the discharging circuit, with compressor intermediate cooling and a common shaft.

Shown schematically in FIG. 5 is an exemplary embodiment of an intermediately cooled compressor 210, comprising a low-pressure sub-compressor 210*b*, an intermediate cooler 221 and a high-pressure sub-compressor 210*a*. The working gas A, which has been cooled in the first cooler 270 almost to ambient temperature, enters the second compressor 210 and is compressed further. The intermediate cooler 221 reduces the required compression energy, and an approximately isothermal compression is achieved. The heat removed by the intermediate cooler 221 is stored in a first fluid storage 152, a hot-water storage. The working gas A is then supplied to the recuperator 130 and is thereby heated. The maximum cycle temperature is achieved upon emergency from the high-temperature regenerator 120. Via the common shaft 214, the second expander 250 drives both the second compressor 210 and the generator 290. The second compressor 210, having an intermediate cooler 221, represented in FIG. 5 has the advantage that the discharging circuit 200 has a high power density. The gas-turbine efficiency can be increased yet further by additional intermediate coolers 221, since the compression thereby approximates yet further to an ideal isothermal compression.

Figure 6:
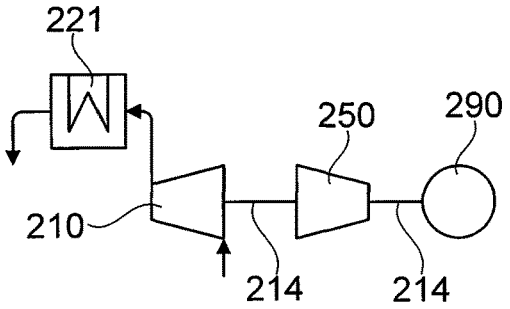
FIG. 6 a detail view of a discharging circuit with compressor post-cooling.
Figure 7:
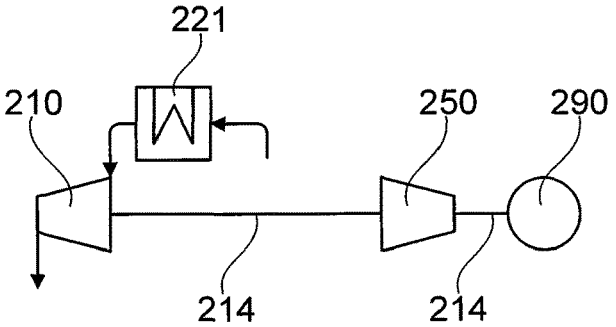
FIG. 7 a detail view of a discharging circuit with compressor pre-cooling.

FIG. 6 shows a further arrangement, in which the second cooler 221 is connected downstream from the second compressor 210. FIG. 7 shows a further arrangement, in which the second cooler 221 is connected upstream from the second compressor 210. Both embodiments, represented in FIGS. 6 and 7, which are also advantageous per se, have a lesser power density and storage efficiency in comparison with the embodiment represented in FIG. 5.

Figure 8:
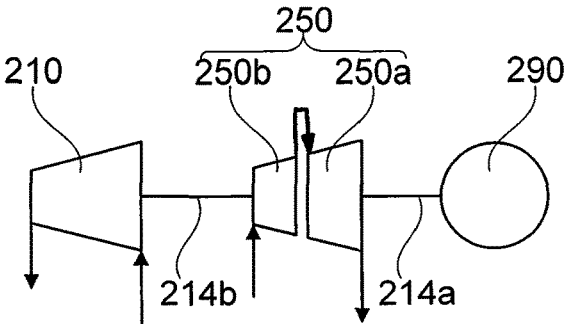
FIG. 8 a detail view of a compressor in the discharging circuit with compressor intermediate cooling and two shafts.

FIG. 8 shows a two-shaft gas-turbine arrangement. The second expander 250 comprises a high-pressure expander 250*b* and a low-pressure expander 250*a*, the high-pressure expander 250*a* being connected, via a second shaft 214*b*, to the second compressor 210 and driving the latter as a free-funning unit, and the low-pressure expander 250*a* being connected to the generator 290 via a first shaft 214*a*. This arrangement has the advantage that two-shaft systems have a better operating behavior in partial load than one-shaft systems, and that standard components such as companders, a combination of an expander and compressor, can be used to economic advantage.

Figure 9:
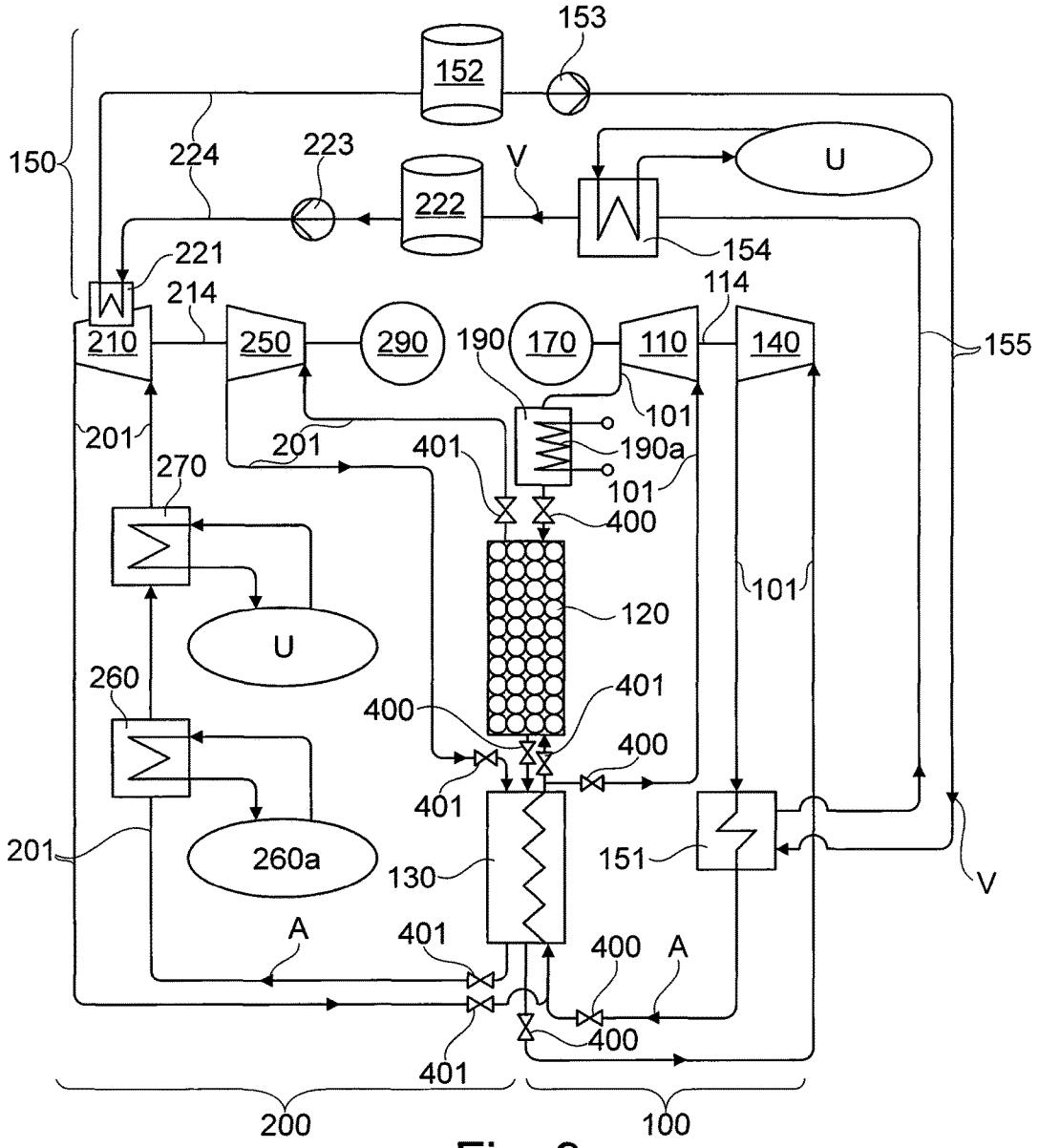
FIG. 9 a third exemplary embodiment of an energy storage device.

FIG. 9 shows a further exemplary embodiment of an energy storage device 1, which again comprises a charging circuit 100, a discharging circuit 200 and a preheating circuit 150. The energy storage device 1 according to FIG. 9 is of a design similar to that of the energy storage device 1 according to FIG. 4, but differs at least in respect of the following aspects:

The preheating circuit 150 is designed as a closed circuit, comprising a closed vessel 22, water preferably being used as a fluid in the closed circuit. In addition, disposed in the preheating circuit 150 there is a heat exchanger 154 that exchanges heat with the environment U. Alternatively, the heat exchanger 154 may also be disposed between the cold-water storage 222 and the conveying means 223. Alternatively, the heat exchanger 154 may also be disposed in the cold-water storage 222, in order to directly exchange heat between the cold-water storage 222 and the environment U or another medium. For example, the cold-water storage 222 could be cooled at night by the heat exchanger 154.

In an advantageous design, the charging circuit 100 comprises an ancillary heating system 190, disposed between the first compressor 110 and the high-temperature regenerator 120. The ancillary heating system 190 serves to reheat the hot working gas A leaving the first compressor 110, for example from 750° C. to 1500° C., in order thereby to increase the energy stored in the high-temperature regenerator 120. The ancillary heating 190 could contain, for example, an electric heating system 190*a* in order to heat the working gas A flowing through. Depending on the increase in the temperature of the working gas A effected by the ancillary heating 190, the thermal energy stored in the high-temperature regenerator 120 can be increased by a considerable factor, for example by a factor 2.

The discharging circuit 200 comprises an addition cooler 260, via which heat for a thermal process 260*a* can be extracted from the discharging circuit 200. The thermal process 260*a* could be, for example, a local heating network for heating dwellings.

Moreover, also represented in FIG. 9 are switching means 400, 401, or valves, that are necessary, in the case of the energy storage device 1 represented, for switching over between the charging operating and the discharging operation, or between the charging circuit 100 and the discharging circuit 200.

The energy storage device 1 represented in FIG. 9 has the advantage, inter alia, that, if required, thermal energy can also be extracted directly, and moreover thermal energy can also be extracted to differing locations and at differing temperature levels. As represented in FIG. 9, the second fluid storage 222 may also be designed, for example, as a closed vessel, an additional heat exchanger 154, which exchanges heat with the environment, being disposed in the preheating circuit 150.

Figure 10:
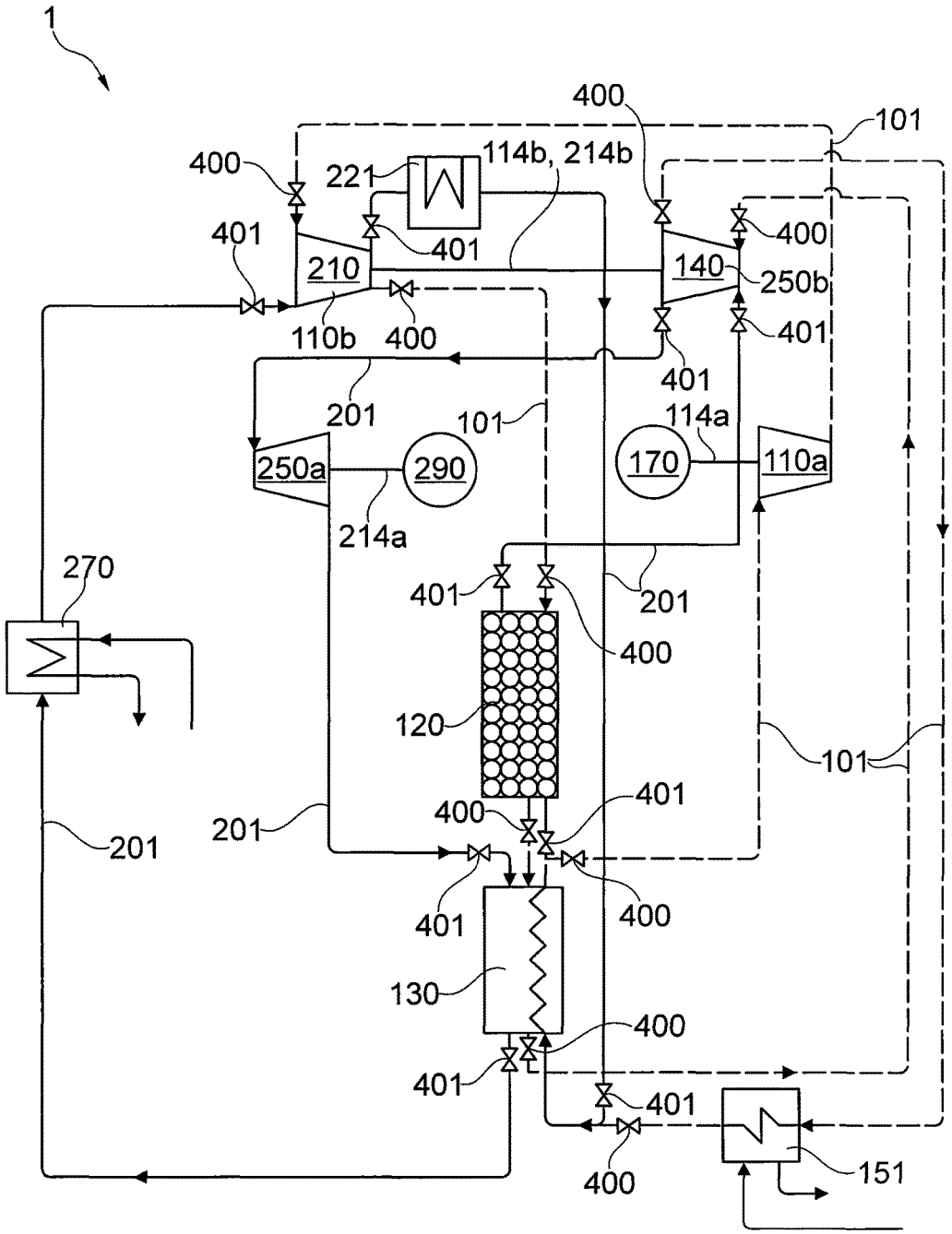
FIG. 10 a fourth exemplary embodiment of an energy storage device.

FIG. 10 shows a further exemplary embodiment of the energy storage device 1, which again comprises a charging circuit 100 having lines 101, a discharging circuit 200 having lines 201, and a preheating circuit 150. The preheating circuit 150 is not represented in detail, but is of the same design as represented in FIG. 9. In FIG. 10, the coolers 221 and the preheater 151 are thus fed by the preheating circuit 150. The cooler 270 cools to ambient temperature U. FIG. 10 shows the energy storage device 1 during the discharging operation, the lines 201 of the discharging circuit 200 being represented by unbroken lines, and all valves 401 being open and all valves 400 being closed. The lines 101 of the charging circuit 100 are represented by broken lines. If all valves 401 are closed and valves 400 are open, the energy storage device 1 is in the charging state. The energy storage device 1 represented is designed as a two-shaft system, and comprises a single turbo-charger, also referred to as a compander, that comprises the second compressor 210, the high-pressure part of the second expander 250*b*, and the second shaft 214*b*. Depending on the position of the valves 400, 401, the turbo-charger is either used as previously described, or used in such a manner that it forms the first expander 140 and the first compressor 110*b*, the first expander 140 and the first compressor 110*b* being connected to each other via the second shaft 114*b*. In comparison with the previously represented exemplary embodiments, this circuit arrangement makes it possible to dispense with a turbo-charger. The low-pressure part of the expander 250*a* is directly connected to the generator 290 via the first shaft 214*a*. The low-pressure part of the first compressor 110*a* is connected to the motor 170, directly via the first shaft 114*a* or via a transmission. The compressor 110*a* could also be connected to the motor 170 via a transmission 172, as represented in FIG. 11*c* or 11*d*. An advantage of the energy storage device 1 represented in FIG. 10 is thus that it requires a single turbo-charger, or compander, of a free-running design. Since the high-pressure part of the second expander 250*b* of the discharging process 200 has to be larger than the high-pressure part of the first expander 140 of the charging process 100, it must be equipped with a close-loop control means that acts on the volume flow rate of the working gas A, in order to deal with the lesser inlet volume flow rate of the expander 140. This energy storage device 1 can thus be produced particularly inexpensively. In contrast, the energy storage devices 1 represented in FIGS. 1, 4 and 9 each require two turbo-chargers, such that they are realized as a two-shaft arrangement.

Figure 11A:
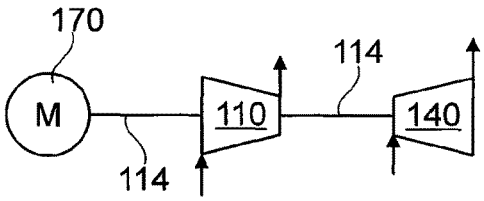
FIG. 11*a*-11*i* differently designed components of heat pumps.
Figure 11B:
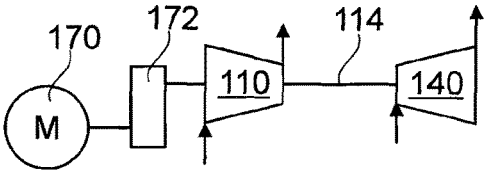
Figure 11C:
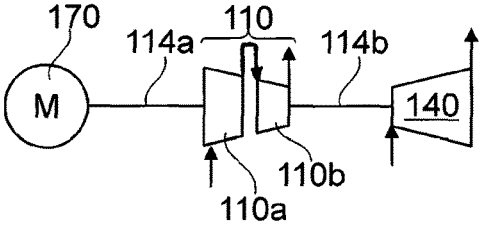
Figure 11D:
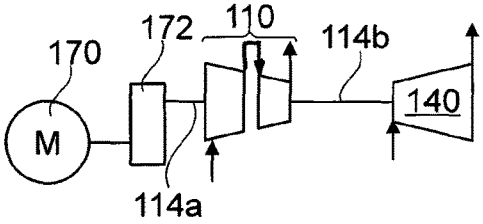
Figure 11E:
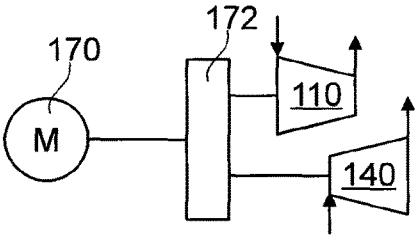
Figure 11F:
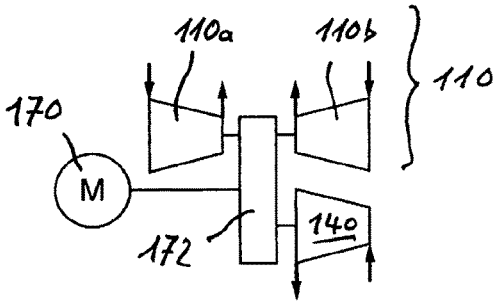

FIGS. 11*a* to 11*h* show differently designed components of heat pumps of the charging circuit 100. FIG. 11*a* shows an arrangement of a motor 170, a first compressor 110 and a first expander 140, which are disposed on a common shaft 114. The first compressor 110 is designed as an axial or inline radial compressor, or as a combination of an axial and radial compressor. Advantageously, the arrangement is operated at a rotational speed of 3000 revolutions per minute, in particular in order to operate the motor 170 at a grid frequency of 50 Hz. The arrangement may also be operated, for example, at a rotational speed of 3600 revolutions per minute, in particular if the motor 170 is operated at a grid frequency of 60 Hz. This arrangement is suitable, in particular, for a large system of, in particular, more than 15 MW. Figure llb shows an arrangement of a transmission 172, a first compressor 110 and a first expander 140, which are disposed on a common shaft 114. In addition, the motor 170 is connected to the transmission 172. The first compressor 110 is designed as an axial or inline radial compressor, or as a combination of an axial and radial compressor. Advantageously, the arrangement is operated at a rotational speed of 3000 revolutions per minute. This arrangement is suitable, in particular, for a smaller system of, in particular, less than 20 MW. FIG. 11*c* shows an arrangement of a motor 170, a first compressor 110 and a first expander 140, the first compressor 110 being of a divided design, and the low-pressure part 110*a* being connected to the motor 170 via a first shaft 114*a*, and the high-pressure part 110*b* being connected to the expander 140 via a second shaft 114*b*, in a free-running manner, and in particular designed as a compander. The low-pressure compressor 110*a* is designed as an axial or radial low-pressure compressor 110*a*. Advantageously, the low-pressure compressor 110*a* is operated at a rotational speed of 3000 revolutions per minute, and the compander rotates in a free-running manner, preferably at a rotational speed of over 3000 revolutions per minute. This arrangement is suitable, in particular, for a large system of, in particular, more than 15 MW. FIG. 11*d* shows an arrangement of a transmission 172, a first compressor 110 and a first expander 140, the first compressor 110 being of a divided design, and one part being connected to the transmission 172 via a first shaft 114*a*, and the other part connected to the expander 140 via a second shaft 114*b*, of a free-running design and, in particular, forming a compander. In addition, the motor 170 is connected to the transmission 172. Advantageously, the low-pressure compressor 110*a* is operated at a rotational speed of over 3000 revolutions per minute, and the compander rotates in a free-running manner, likewise preferably at a rotational speed of over 3000 revolutions per minute. This arrangement is suitable, in particular for a small system of, in particular, less than 20 MW. FIG. 11*e* shows an arrangement of a transmission 172, a first compressor 110 and a first expander 140, the first compressor 110 and the first expander 140 being connected to the transmission 172, in order to adapt their rotational speed via the transmission 172. In addition, the motor 170 is connected to the transmission 172. The first compressor 110 is designed as a radial compressor. The transmission 172 provides for mutual adaptation of the rotational speed of the first compressor 110 and of the first expander 140. Owing to the inherent flexibility of the arrangement, it is suitable for a wide power spectrum, of up to 40 MW. FIG. 11*f* shows an arrangement of a transmission 172, a first compressor 110 and a first expander 140, the first compressor 110 comprising a low-pressure compressor 110*a* and a high-pressure compressor 110*b*, the low-pressure compressor 110*a*, the high-pressure compressor 110*b* and the first expander 140 being connected to the transmission 172, in order to adapt their rotational speed via the transmission 172. The low-pressure compressor 110*a* and the high-pressure compressor 110*b* are designed as radial compressors. Owing to the inherent flexibility of the arrangement, it is suitable for a wide power spectrum, of up to 40 MW.

Figure 11G:
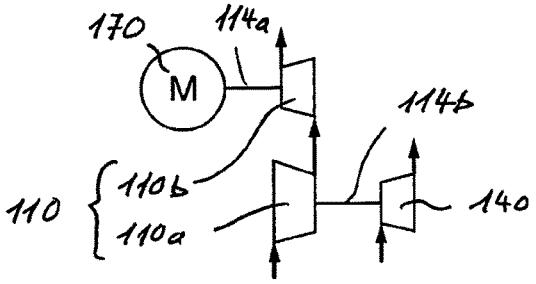
Figure 11H:
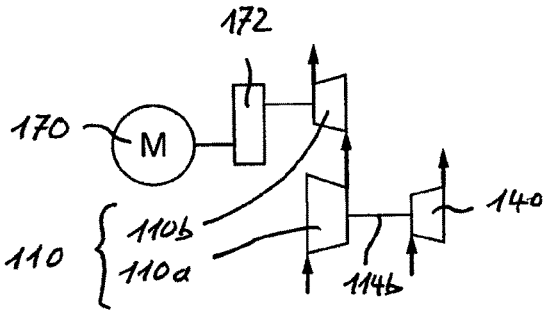

FIG. 11*g* shows an arrangement of a motor 170, a first compressor 110 and a first expander 140, the first compressor 110 being of a divided design, and the high-pressure compressor 110*b* being connected to the motor 170 via a first shaft 114*a*, and the low-pressure compressor 110*a* being connected to the expander 140 via a second shaft 114*b*, in a free-running manner, and in particular designed as a turbo-charger. The high-pressure compressor 110*b* is designed as a piston compressor that is preferably driven, without an intermediate transmission, by the motor 170. The low-pressure compressor 110*a* is designed as an axial or radial low-pressure compressor 110*a*. The expander 140 is designed as an axial or radial expander and, together with the low-pressure compressor 110*a*, forms the turbo-charger. Advantageously, the high-pressure compressor 110*b* is operated at a rotational speed of 3000 revolutions or 1500 revolutions per minute, and the turbo-charger rotates in a free-running manner, preferably at a rotational speed of over 3000 revolutions per minute. This arrangement is suitable, in particular, for a small system of, in particular, less than 2 MW. FIG. 11*h* shows a further design of a heat pump that, unlike the embodiment represented in FIG. 11*g*, additionally comprises a transmission 172, such that the high-pressure compressor 110*b*, designed as a piston compressor, is driven by the motor 170 via the transmission 172. Advantageously, the motor 170 is operated at a grid frequency of 50 Hz, and in particular at a rotational speed of 3000 revolutions or 1500 revolutions per minute, whereas the piston compressor is operated at a rotational speed increased by the transmission ratio of the transmission 172, for example greater than 3000 revolutions per minute.

Figure 11I:
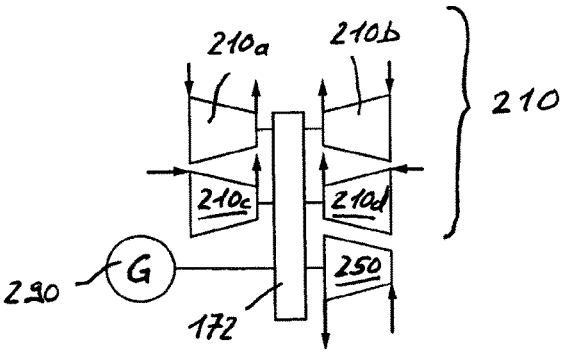

FIG. 11*i* shows components of a discharging circuit 200 in detail. FIG. 11*i* shows an arrangement having a second expander 250 that drives a transmission 172, the transmission 172 driving a second compressor 210 comprising four sub-compressors 210*a*, 210*b*, 210*c*, 210*d* and a generator 290. The arrangements represented in FIGS. 11*a* to 11*h* could also be used for a discharging circuit 200, in that the motor 170 is replaced by a generator 290, the first compressor 110 is replaced by the second compressor 210, and the first expander 140 is replaced by the second expander 250.

In the case of the exemplary embodiments represented in FIGS. 1 to 11*i*, the charging circuit 100 and the discharging circuit 200 are advantageously operated in a pressurized manner. The first compressor 110 and the second compressor 210 are preferably designed as a radial or axial compressor. Particularly advantageous is the use of a transmission compressor, to the transmission 172 of which the expander 140 can also be connected, as represented in FIG. 11*e* or 11*f*. However, the first and/or the second compressor 110, 210 could also be designed as a piston compressor, as represented in FIGS. 11*g* and 11*h*, as a screw-type compressor. The first compressor 110 and the second compressor 210 preferably do not have a closed-loop control means. However, the first and the second compressor 110, 210 could also be equipped with a through-flow closed-loop control means. Preferably, in the case of the first compressor or second compressor 110, 210, of radial and axial type, the through-flow closed-loop control means consists of one or more inlet guide vanes. In a possible embodiment, in the case of a first compressor 110 or second compressor 210, of radial and axial type, the through-flow closed-loop control means could consist of one or more adjustable diffusers. Optionally, in the case of the first or second compressor 110, 210, of radial or axial type, the through-flow closed-loop control could consist of a combination of inlet guide vane and diffusor closed-loop control.

Preferably, the first compressor 110 is not cooled. Optionally, the first compressor 110 may also be equipped with a cooling means.

The high-temperature regenerator 120 is advantageously a pressure-proof, temperature-resistant, thermally insulated vessel. The high-temperature regenerator 120 is advantageously equipped with a porous, temperature-resistant heat storage material 121, the working gas A flowing into the free spaces of the high-temperature regenerator 120. Advantageously, the high-temperature regenerator 120 is disposed vertically, and during charging preferably receives a through-flow from top to bottom, and from bottom to top during discharging.

The first expander 140 and the second expander 250 are preferably of the radial or axial expander type. Optionally, the first and the second expander 140, 250 may be of the piston expander type. The first and the second expander 140, 250 of the radial or axial type preferably do not have closed-loop control. Optionally, the first and the second expander 140, 250 of the radial and axial type may be equipped with a volume flow rate closed-loop control.

The fluid in the preheating circuit 150 is preferably water. Optionally, other fluids could also be used, such as, for example, a mixture of water and (mono)ethylene glycol. The preheating circuit 150 is preferably operated in an unpressurized manner. Optionally, the preheating circuit 150 may be operated in a pressurized manner. For this case, the preheating circuit 150 is realized so as to be pressure-proof.

Preferably, the drive 170 of the charging circuit 100 is designed as an electric motor. Optionally, the electric motor is equipped with a frequency converter. Optionally, the drive 170 of the charging circuit 100 is a steam turbine. Optionally, the drive 170 of the charging circuit 100 is a gas turbine. Optionally, the drive 170 of the charging circuit is an internal combustion engine. Preferably, the rotating components of the charging circuit 100 are operated at a constant rotational speed. Optionally, the rotating components of the charging circuit 100 are operated at a variable rotational speed.

Preferably, the load 290 of the discharging circuit 200 is designed as a generator. Optionally, the generator is equipped with a frequency converter. Optionally, the load 290 of the discharging circuit 200 a compressor. Optionally, the load 290 of the discharging circuit 200 is a pump. Optionally, the load 290 of the discharging circuit 200 is a propeller. Preferably, the rotating components of the discharging circuit 200 are operated at a constant rotational speed. Optionally, the rotating components of the discharging circuit 200 are operated at a variable rotational speed.

In a further possible exemplary embodiment, air could also be used as a working gas, in which case it must then be ensured that the storage material in the high-temperature regenerator 120 is composed of a non-combustible material.

A transmission 172 may comprise a plurality of rotating shafts. For example, the transmission 172 in FIG. 11*f*, driven by the motor 170, could also comprise more than four shafts, for example also five, six, seven or eight. Such a transmission 172 has the advantage that, for example, identical compressors can be operated in parallel. Thus, in FIG. 11*f* for example, the two compressors 110*a* and 110*b* could be of identical design, and have a common supply and a common discharge for the fluid, such that the two compressors 110*a*, 110*b* can be operated at the same rotational speed and in parallel. However, the transmission 172 also makes it possible, for example, for the two compressors 110*a*, 110*b* to be operated in series.

The invention claimed is:

1. An energy storage device for storing energy, comprising:

a high-temperature regenerator containing a solid, in particular porous, storage material, and a working gas as a heat transfer medium, for the purpose of exchanging heat between the storage material and the working gas flowing through, a closed charging circuit for the working gas, comprising a first compressor, a first expander, a first recuperator that has a first and a second heat exchange duct, the high-temperature regenerator and a preheater, wherein the first compressor is coupled to the first expander by means of a shaft, and wherein the charging circuit is realized in such a manner that, starting from the high-temperature regenerator, at least the first heat exchange duct of the recuperator, the first expander, the preheater, the second heat exchange duct of the recuperator, the first compressor, and then the high-temperature generator, are connected to each other in a fluid-conducting manner, forming a closed circuit, and a closed discharging circuit wherein a switching means in a fluid-conducting manner connects the high-temperature regenerator either to the charging circuit or to the discharging circuit in a controllable manner, such that the high-temperature regenerator forms either a part of the charging circuit or a part of the discharging circuit, and the charging circuit, the discharging circuit and the high-temperature regenerator have the same working gas, such that the working gas comes into direct contact with the storage material, both in the charging circuit and in the discharging circuit.

2. The energy storage device as claimed in claim 1, wherein the discharging circuit comprises a second compressor a second expander, a second recuperator having a first and a second heat exchange duct, the high-temperature regenerator and a first cooler, wherein the second compressor is coupled to the second expander via the shaft, and wherein the discharging circuit is realized in such a manner that, starting from the high-temperature regenerator, at least the second expander, the first heat exchange duct of the second recuperator, the first cooler, the second compressor, the second heat exchange duct of the recuperator, and then the high-temperature regenerator, are connected to each other in a fluid-conducting manner, forming the closed circuit.

3. The energy storage device as claimed in claim 2, wherein the discharging circuit comprises a second cooler, which, in the discharging circuit, is connected upstream, intermediately or downstream in respect of the second compressor.

4. The energy storage device as claimed in claim 3, wherein a preheating circuit comprises a cold-water storage, a hot-water storage, the second cooler and the preheater, wherein the preheating circuit is designed in such a manner that, starting from the cold-water storage, at least the second cooler, the hot-water storage, the preheater and then the cold-water storage are connected to each other in a fluid-conducting manner, forming a circuit.

5. The energy storage device as claimed in claim 1, wherein the compressor comprises at least two sub-compressors, a low-pressure sub-compressor and a high-pressure sub-compressor, the compressor comprises at least two separate shafts, and the expander and the high-pressure sub-compressor are disposed on a common shaft.

6. The energy storage device as claimed in claim 1, wherein the first and the second recuperator are designed as a common recuperator, and the switching means are disposed in such a manner that the common recuperator realizes, in controllable manner, either a part of the charging circuit or of the discharging circuit.

7. The energy storage device as claimed in claim 2, wherein that the first expander and the first compressor are connected to a motor via a common shaft, and the second expander and the second compressor are connected to a generator via a common shaft.

8. The energy storage device as claimed in claim 1, wherein that the storage material of the high-temperature regenerator is porous materials, sand, gravel, stones, concrete, graphite, or a ceramic such as silicon carbide.

9. The energy storage device as claimed in claim 1, wherein that the working gas is argon or nitrogen.

10. The energy storage device as claimed in claim 1, wherein an ancillary heating system is provided, which is connected before the high-temperature regenerator in the charging circuit, such that the working gas can be heated before entering the high-temperature regenerator.

11. A method for storing energy in an energy storage device comprising a high-temperature regenerator that contains a solid storage material, in that a working gas is circulated, as a heat transfer medium, in a closed charging circuit, wherein the working gas exchanges heat with the storage material, and wherein the working gas after the high-temperature regenerator is cooled in a first recuperator, then expanded in a first expander, then preheated in a first preheater, then heated in the first recuperator, then compressed in a compressor and heated, and the thus heated working gas is supplied to the high-temperature regenerator, and wherein thermal energy is removed from the high-temperature regenerator via a closed discharging circuit, wherein the high-temperature regenerator forms either a part of the charging circuit or a part of the discharging circuit, in that the high-temperature regenerator is switched in a fluid-conducting manner either into the charging circuit or into the discharging circuit, wherein the same working gas flows through the charging circuit, the discharging circuit and the high-temperature regenerator, such that the working gas (A) flows around the storage material, both in the charging circuit and in the discharging circuit.

12. The method as claimed in claim 11, characterized in that, in the discharging circuit, the working gas, after emerging from the high-temperature regenerator, is expanded in a second expander, then cooled in a second recuperator, then cooled in a first cooler, then compressed in a second compressor and is thereby heated, then heated again the recuperator, and then supplied back to the high-temperature regenerator.

13. The method as claimed in claim 12, wherein that the first compressor is driven by an electric motor, and a generator is driven by the second expander, in order to supply and extract electrical energy.

14. The method as claimed in claim 11, wherein that a preheating circuit comprises at least one water storage, and at least the preheater is heated with water via the preheating circuit.

15. A use of an energy storage device as claimed in claim 1 for storing electrical energy and delivering electrically energy in a deferred manner.

* * * * *